US008727756B2

(12) United States Patent
Pokorný et al.

(10) Patent No.: US 8,727,756 B2
(45) Date of Patent: May 20, 2014

(54) COMBINED SPINNING NOZZLE FOR THE MANUFACTURE OF NANOFIBROUS AND MICROFIBROUS MATERIALS

(71) Applicant: Contipro Biotech, s.r.o., Dolní Dobrouč (CZ)

(72) Inventors: Marek Pokorný, Jablonné nad Orlicí (CZ); Lada Suková, Dobruška (CZ); Jiři Řebíček, Polička (CZ); Vladimír Velebný, Zamberk (CZ)

(73) Assignee: Contipro Biotech s.r.o., Dolni Dobrouc (CZ)

( * ) Notice: Subject to any disclaimer, the term of this patent is extended or adjusted under 35 U.S.C. 154(b) by 0 days.

(21) Appl. No.: 13/737,278

(22) Filed: Jan. 9, 2013

(65) Prior Publication Data

US 2014/0030370 A1 Jan. 30, 2014

(30) Foreign Application Priority Data

Jan. 19, 2012 (CZ) ..... 2012-33

(51) Int. Cl.
*D01D 5/00* (2006.01)

(52) U.S. Cl.
USPC ..... 425/72.2; 425/174.8 E

(58) Field of Classification Search
USPC ..... 425/72.2, 174.8 E
See application file for complete search history.

(56) References Cited

U.S. PATENT DOCUMENTS

| | | | | |
|---|---|---|---|---|
| 692,631 | A | 2/1902 | Cooley | |
| 705,691 | A | 7/1902 | Morton | |
| 1,975,504 | A | 10/1934 | Formhals | |
| 2,048,651 | A | 7/1936 | Norton | |
| 3,192,562 | A * | 7/1965 | Powell | 425/131.5 |
| 2008/0150197 | A1 | 6/2008 | Chang et al. | |

FOREIGN PATENT DOCUMENTS

| | | |
|---|---|---|
| CZ | 302 876 | 12/2010 |
| EP | 1 409 775 | 2/2003 |
| KR | 100587193 | 3/2006 |
| WO | 2004/016839 | 2/2004 |
| WO | 2005/024101 | 3/2005 |

(Continued)

*Primary Examiner* — Dimple Bodawala
*Assistant Examiner* — Joseph Leyson
(74) *Attorney, Agent, or Firm* — Wood, Herron & Evans, LLP

(57) ABSTRACT

The combined spinning nozzle for the production of nanofibrous or microfibrous materials comprises a thin-walled electrode (1) and a first non-conductive body (2) adjoining the first wall of said thin-walled electrode, said first body having its wall, which faces the thin-walled electrode (1), provided with an array of grooves (5) formed therein, said grooves leading to the distal end (6) of the combined spinning nozzle and having their proximal ends connected to a supply of spinning mixture. The thin-walled electrode (1) and the first non-conductive body (2) may assume either plate-like or cylindrical shapes. The combined spinning nozzle may further comprise a second non-conductive body (4) adjoining a second wall of the thin-walled electrode (1) and directing the air from the proximal end towards the distal end (6) of the nozzle.

6 Claims, 2 Drawing Sheets

(56) References Cited

FOREIGN PATENT DOCUMENTS

| | | |
|---|---|---|
| WO | 2005/033381 | 4/2005 |
| WO | 2007/035011 | 3/2007 |
| WO | 2007/061160 | 5/2007 |
| WO | 2009/042128 | 4/2009 |
| WO | 2009/156822 | 12/2009 |
| WO | 2010/043002 | 4/2010 |
| WO | 2010/143916 | 12/2010 |
| WO | 2010/144980 | 12/2010 |

* cited by examiner

Fig. 1
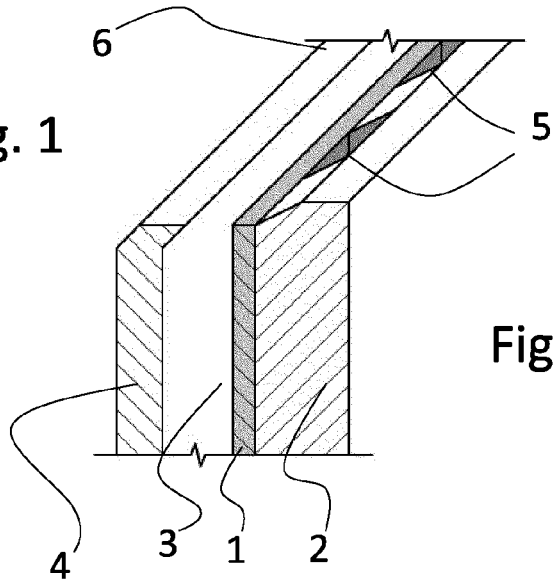
Fig. 2
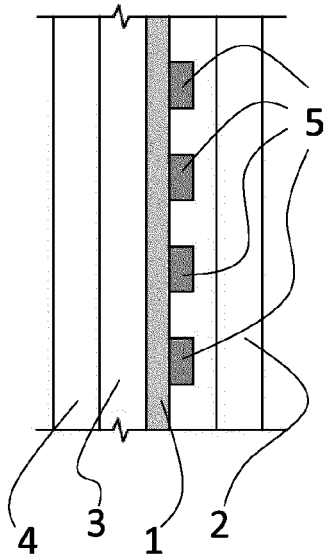
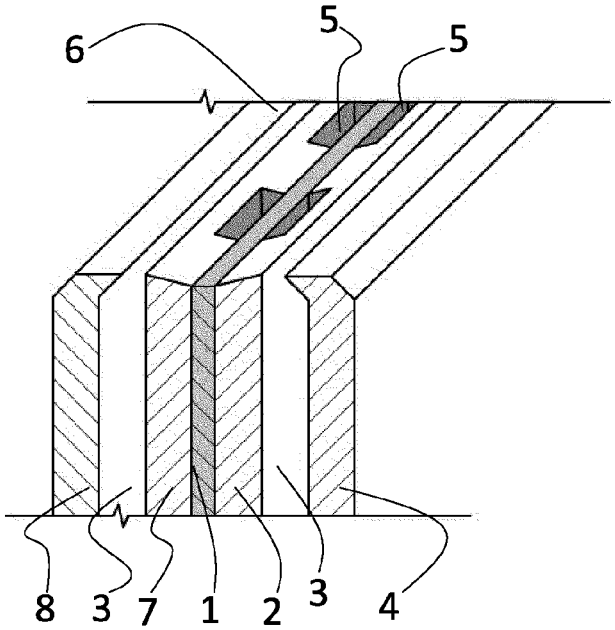
Fig. 3
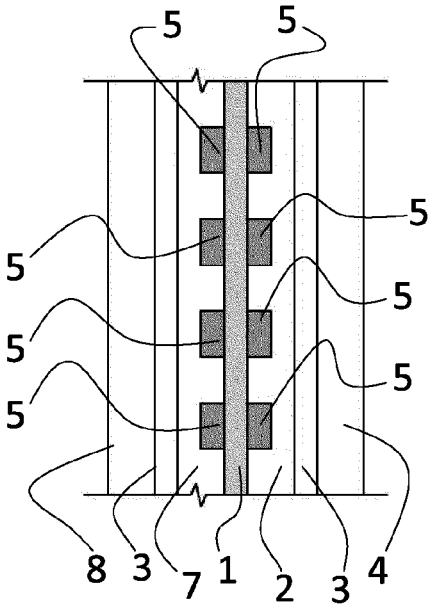
Fig. 4

COMBINED SPINNING NOZZLE FOR THE MANUFACTURE OF NANOFIBROUS AND MICROFIBROUS MATERIALS

CROSS REFERENCE TO RELATED APPLICATION

This application claims priority to Czech Patent Application No. PV 2012-33 filed Jan. 19, 2012, the disclosure of which is incorporated reference herein in its entirety.

TECHNICAL FIELD

The invention relates to a device for manufacturing nanofibrous or microfibrous materials, comprising a combined nozzle connected to one of the electric potential points of a high-voltage power supply and linked, by means of distribution channels, to a device for proportioning a polymeric mixture, said nozzle being passed by the air flowing in close vicinity to the appropriately shaped polymeric mixture.

PRIOR ART

The method of electrostatic spinning used for producing nanofibrous or microfibrous materials is based on the utilization of two electrodes connected to reversed electric potential points. One of said electrodes serves for proportioning a polymeric solution and for shaping the same into curved forms having small radiuses of curvature. Due to the action of the forces induced by a strong electric field, a so called Taylor cone is formed and, simultaneously, a fibre is created, the latter being attracted by the electrostatic forces to the other, i.e. opposite electrode having reversed polarity and serving for capturing the flying fibres. After having been captured, the fibres successively form a continuous layer on the surface of said opposite electrode, the layer being composed of randomly arranged fibres with a small diameter (generally ranging between tens of nanometers and several micrometers). In order to actually enable the creation of a fibre in the strong electric field, a number of conditions must be met with respect to the physical and chemical properties of the polymeric solution itself as well as to the ambient influences and the geometry of the electrodes.

In the electrostatic spinning method, the individual fibres are formed from the surface of the polymeric mixture under the action of electrostatic forces. Liquids or viscous solutions are subject to internal cohesive forces and capillary forces. The capillary forces are dependent on the surface tension and on the size of the element of surface of the respective liquid in direct proportion and on its radius of curvature in inverse proportion. If the radius of curvature is reduced, the internal forces in the liquid, which act on the surface layer of the liquid among others, will rise, causing the pressure inside the liquid or viscous polymeric mixture to rise accordingly. Such reduction of the radius of curvature takes place, for example, in thin capillaries where the effects of capillary elevation or depression occur. The above mentioned effects (particularly that of capillary depression) are preferably used for adapting the shape of a polymeric mixture prior to starting the spinning process itself. In order to enable the creation of the Taylor cone and jetting of the processed polymer, the external electrostatic forces must overcome the cohesive and capillary ones. The creation of the Taylor cone is primarily supported by the curvature of the surface of the polymeric mixture accomplished by means of an appropriately shaped nozzle (the reduction of the surface curvature will give rise to increased capillary forces that will, in turn, cause the pressure inside a drop to increase and act towards the breakage of the surface layer of the drop and thus to the destruction of the drop itself). In this respect, the usage of a thin capillary, into which the processed polymeric mixture is forced, will be most beneficial for the electrostatic spinning process. The mixture is then formed into a very small drop in the area around the orifice of the capillary. The mixture will be caused to jet forth (and the initiation of the process itself will be enabled, when polymeric mixtures with unfavourable spinning properties are to be processed) under the action of the electrostatic forces that are weaker than those acting in a free-formed drop of the polymeric mixture (having a greater diameter of surface curvature). Therefore, the essential and most commonly applied principle of a spinning nozzle involves a thin hollow needle in combination with continuous proportioning of a polymeric mixture that is forcibly pressed into the nozzle. For the above reasons, a plurality of principally different types of spinning nozzles have been developed. In this respect, the following basic arrangements are feasible:

Primarily, a thin capillary needle used as spinning nozzle is known. In all likelihood, this type of nozzle is the most widespread one as far as the preparation of nanofibres and microfibres in laboratory condition is concerned. The main advantages include simplicity, relative ease of proportioning and shaping of the processed polymeric mixture into the form of a droplet having a very small diameter facilitating the creation of the Taylor cone as well as of the subsequently produced fibre (which is also supported by a marked gradient of the electrostatic field generated in the area of the tip of the needle, where the locally acting electrostatic forces are multiplied, thus making the creation of fibres easier). Capillary nozzles are frequently used in laboratory devices but are not efficient enough for the needs of industrial production. A similar solution was disclosed in the original U.S. Pat. Nos. 0,705,691 and 0,692,631 published in the years 1900 and 1902 respectively and relating to the liquid dispersions, wherein the processes are based on the principles that are equal to those underlying the contemporary electrostatic spinning method.

Another known spinning nozzle consists of a displaceable capillary needle. The capillary needle performs lateral movement (similar to that of a printing head) in order to cover a larger area of the opposite electrode during the application of the fibres forming a coating layer. In principle, however, the embodiment is based on the foregoing type. Although the needle is capable to produce fibrous materials in increased volumes, its overall productivity still remains very low.

Furthermore, manifold nozzles are known. Such nozzles are also based on the first type described above, the individual capillary needles being grouped together in higher quantities in order to increase the productivity of the corresponding spinning processes, as disclosed, e.g., in the patent applications WO2007035011(A1), WO2004016839(A1), and WO2007061160(A1). The main disadvantage of such manifold nozzles is posed by the problems related to the uneven distribution of spinning solutions and to the tendency of the nozzles to get fouled (clogged) which requires exacting subsequent cleaning and makes the overall maintenance more demanding.

Another known spinning nozzle is a coaxial nozzle. Thin double capillary coaxial nozzles are supplied with two polymeric mixtures that are different in type. Hence, the final fibres have their cores and sheaths made of different materials.

Needleless spinning electrodes are also known in the art. Such electrodes utilize the natural ripple (curvature) of free surfaces or thin layers of polymeric mixtures in order to transform the latter into fibres by means of the forces induced by electrostatic fields. For this type of nozzles, a higher level of processing productivity is expected. This is based on the assumption that the Taylor cones can be simultaneously created in multiple locations of a free surface. Nevertheless, the above assumption has not been experimentally proven so far. Moreover, the application of such systems is limited to a narrow range of easily spinnable polymers. The main disadvantage, which is critical in terms of large-scale production, consists in the variation of the properties of solutions during spinning processes because the latter are carried out under open climatic conditions where the components of the solutions are subject to natural evaporation and to uncontrolled changes in physical and chemical parameters.

In such cases, the formation of Taylor cones occurs directly on the free surface of the polymeric mixture. Alternatively, Taylor cones are formed from larger drops which assume natural shapes in smaller areas of the spinning electrode. All the above needleless (or jetless) spinning systems are undoubtedly based on the original U.S. Pat. No. 1,975,504 and U.S. Pat. No. 2,048,651 (published in the years 1934 and 1936 respectively) which are also fundamental to the contemporary electrostatic method used for the preparation of nanofibres and microfibres. Such nozzles are formed, for example, as cups filled with the polymeric mixture in which a rotating cylinder is partly immersed. The rotation of the cylinder causes the polymeric mixture to wet the outer surface of the same, causing Taylor cones to form on the opposite side. In this way, the formation of the fibres is enabled. Later patent documents, such as EP1409775(A1), WO2005024101(A1), WO2009156822, and US2008150197(A1), describe a very similar jetless arrangement having the same working principle. The main drawback of such rotating needleless nozzles consists in the variation of the parameters of polymeric mixture during the spinning process. This is due to the occurrence of continuous surface reactions and evaporation of the components of the spinning mixture both inside the cup and on the extensive surface of the cylinder. Thus, the spinning mixture is subject to considerable changes during the process (particularly in terms of concentration, viscosity, chemical composition etc.). For this reason, the properties of the fibres being applied also vary. Such variation in properties (diameter, chemical composition and morphology of the fibres) cannot be influenced in any controlled manner. In many cases, the spinning process spontaneously ceases after a few minutes and the entire volume of the spinning mixture has to be replaced. Hence, the production is ineffective and costly since the composition of the incompletely processed spinning mixtures is entirely unknown and the recovery of the same is not feasible. Another disadvantage arises from the numerical simulations of the distribution of the electrostatic field which were performed by the applicant. This disadvantage consists in that the active surface, on which the Taylor cones may develop, is relatively large (in comparison to the use of a capillary nozzle). There is a markedly smaller gradient on the surface of a needleless nozzle and the external electrostatic forces are not sufficiently strong for starting the spinning process. This technology cannot be used for processing of difficultly spinnable materials.

This category may also include a so called flooding electrode that enables the fibres to be formed in the areas where the polymeric mixture is flowing over a convex body or is flooding the same (PPVCZ2009-0425A3). However, the latter method consumes a considerable quantity of the polymeric mixture and does not provide any suitable possibility of recovery. There is no sufficient gradient of the electric field on the convex surface of the conductive body which makes the processing of difficultly spinnable polymeric mixtures completely impossible.

A special group includes those spinning mechanisms which support the formation of the Taylor cone in a more efficient manner and also employ other principles supporting the initiation and progress of the spinning process. This is especially desirable with respect to the mixtures which cannot be transformed into nanofibres or microfibres by means of classical techniques. The effect of the electrostatic forces may be further supported by the tangential component of the air flowing in close vicinity of the capillary nozzle, as published in the documents WO2005033381, WO 2010143916(A2), WO 2010144980(A1) and also by Ji, Ghosh et al., 2006, Medeiros, Glenn et al. 2009, or Larsen, Spretz et al. 2004. Such hot-air nozzles combine the utilization of thin capillary needles around which preheated air is blasted in. The tangential forces created by the flowing air act on the surface of the polymeric solution, thus supporting the formation of Taylor cones and, in turn, the formation of fibres. Therefore, the hot-air nozzles are used for processing of difficultly spinnable polymeric mixtures. The advantage of the latter arrangement consists in that the temperature of the flowing air can be controlled so that the air can, e.g., actively support the rapid solidification of the polymeric ray (fibre). That is why the above principle is very desirable. Moreover, the preheated air favourably influences the climatic conditions inside the deposition chamber, thus accelerating the evaporation of the solvents contained in the polymeric mixture. In terms of the physical and chemical properties of the polymeric solution, the latter technology does not require frequent use of toxic solvents or surfactants. Nevertheless, the main disadvantages of this technical solution consist both in the low efficiency of the spinning process and in the complicated maintenance and cleaning of the capillary nozzles, as mentioned above. Further disadvantages of all the above technical solutions include complex shape designs of the nozzles. The thin nozzle is enclosed by a conductive material, which substantially suppresses the gradient of the electrostatic field generated around the orifice of the nozzle where, as a matter of principle, the action of strong electrostatic forces is particularly desirable. Such reduction of electrostatic forces will prevent the spinning process from being started, notwithstanding the additional action of the forces created by the flowing air. Another disadvantage is related to the direct contact of the preheated air with the metallic nozzle where the transfer causes the polymeric mixture to warm up and, as the case may be, to solidify. Then, the solidified mixture accumulates inside the orifice of the nozzle causing clogging the same and subsequent discontinuation of the process.

Another known spinning nozzle is a bubble nozzle. The bubble nozzle is composed of two coaxial tubes, wherein the inner portion server for air blasting and the outer part serves for the dosage of a polymeric solution which is, due to the effect of the flowing air, shaped into thin-walled bubbles. Such forming of thin-walled bubbles contributes to the initiation of the process and to the subsequent creation of fibres, a described in WO2009042128.

Finally, combination of the above types are also known. An exemplary version may comprise a rotating wire helix, as described in WO2010043002(A1).

SUMMARY OF THE INVENTION

The objective of the present invention is to present a novel design solution of a combined nozzle which is usable for the electrostatic spinning method and intended for the production of nanofibrous or microfibrous materials. The spinning nozzle according to the invention should eliminate the drawbacks of the nozzles known in the art. The above objective is, to a large extent, achieved by means of a combined spinning nozzle for the production of nanofibrous or microfibrous materials, wherein said nozzle comprises a thin-walled electrode and a first non-conductive body adjoining the first wall of said thin-walled electrode, said first body having its wall, which faces said thin-walled electrode, provided with an array of grooves formed therein and leading to the distal end of the combined spinning nozzle. Said grooves have their proximal ends connected to a supply of spinning mixture. A collecting electrode is arranged in a location having a given distance from the distal end of the combined spinning nozzle and a voltage supply is wired between said collecting electrode and said thin-walled electrode.

In a preferred embodiment of the present invention, the combined spinning nozzle further comprises a second non-conductive body adjoining the second wall of the thin-walled electrode and directing the air from the proximal end towards the distal end of the combined spinning nozzle.

In another preferred embodiment of the present invention, the thin-walled electrode assumes the form of a cylindrical shell, in which the first non-conductive body having cylindrical shape and being provided with grooves on its surface is accommodated, while the second non-conductive body serving to direct gaseous media from the proximal end towards the distal end of the combined spinning nozzle is shaped as a cylindrical sheath. The thin-walled electrode is accommodated in a cylindrical casing made of a non-conductive material. Between said cylindrical casing made of a non-conductive material and the second non-conductive body, there is a coaxial inner space, the latter being arranged for directing the air towards the distal end of the combined spinning nozzle.

This embodiment is particularly advantageous if the distal end of the cylindrical casing made of a non-conductive material is situated below the level of the distal end of the thin-walled electrode.

In another preferred embodiment of the present invention, the thin-walled electrode, the first non-conductive body and the second non-conductive body have plate-like shapes, the first wall of said thin-walled electrode being adjoined by said first non-conductive body, the surface of the latter adjoining said thin-walled electrode being provided with grooves leading towards the distal end of the same. Opposite the second wall of the thin-walled electrode, the second non-conductive body is arranged which defines a space between itself and the thin-walled electrode, said space serving for directing the air towards the distal end of the combined spinning nozzle.

In a still another preferred embodiment of the combined spinning nozzle for the production of nanofibrous or microfibrous materials according to the invention, said nozzle is provided with the third and fourth non-conductive bodies, the thin-walled electrode as well as the first, second, third and fourth non-conductive body, respectively, have plate-like shapes. The second wall of the thin-walled electrode is adjoined by the first wall of the third non-conductive body, the surface of the latter adjoining the thin-walled electrode being provided with grooves extending from the proximal towards the distal end of the thin-walled electrode. Opposite the second wall of the first non-conductive body, the second non-conductive body is arranged which defines a space between itself and the first non-conductive body, said space serving for directing the air towards the distal end of the combined spinning nozzle. Opposite the second wall of the third non-conductive body, the fourth non-conductive body is arranged which defines a space between itself and the third non-conductive body, said space serving for directing the air towards the distal end of the combined spinning nozzle.

BRIEF DESCRIPTION OF THE DRAWINGS

For more detail, the invention will be further described by means of the accompanying drawings wherein FIG. 1 is a perspective cross-sectional view showing a single-ended linear combined spinning nozzle according to the invention, FIG. 2 is a top view showing the single-ended linear combined spinning nozzle of FIG. 1, FIG. 3 is a perspective cross-sectional view showing a double-ended linear combined spinning nozzle according to the invention, FIG. 4 is a top view showing the double-ended linear combined spinning nozzle of FIG. 3.

EXEMPLIFYING EMBODIMENTS OF THE INVENTION

Figure 5:
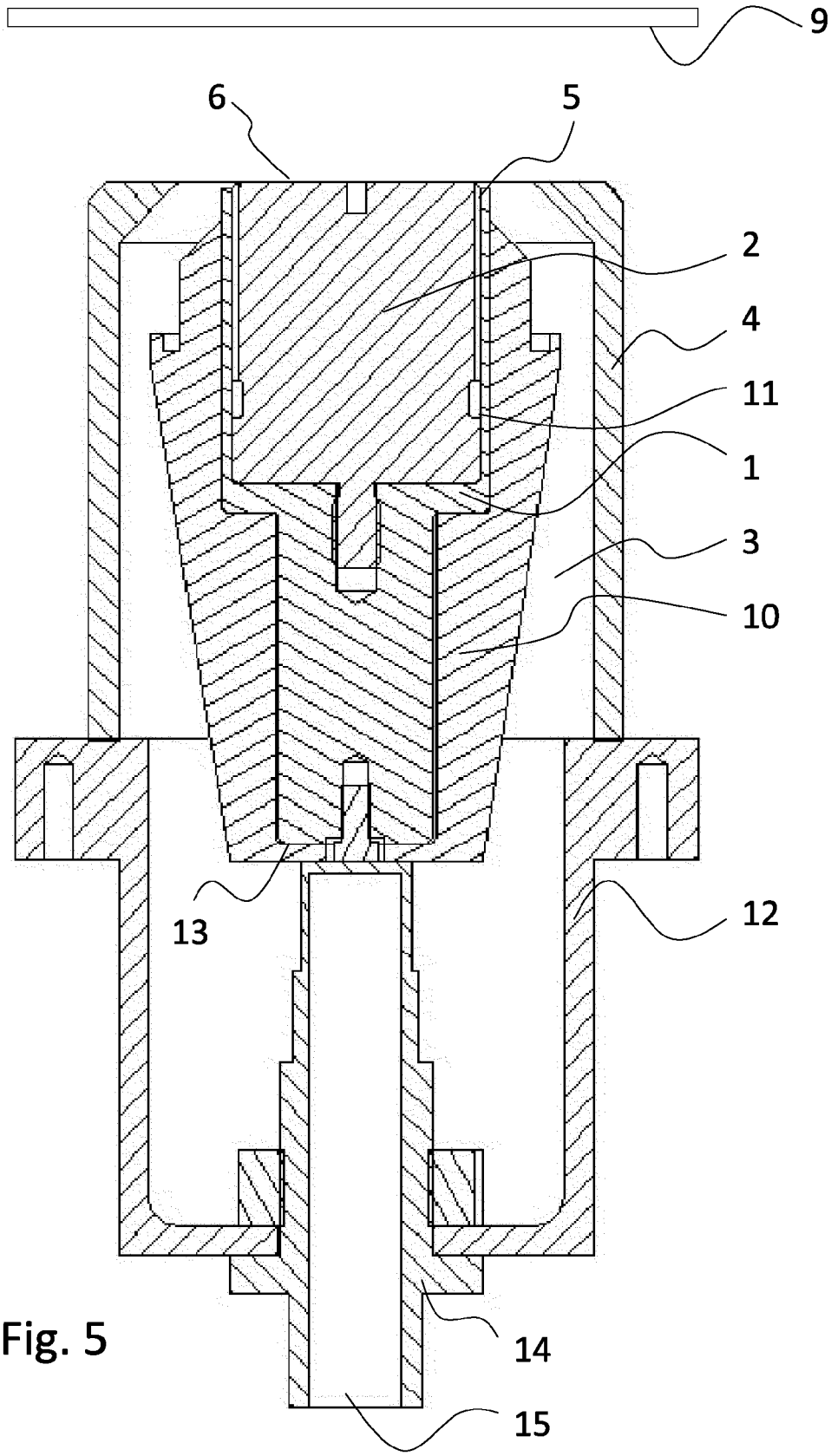
FIG. 5 is a sectional view showing a cylindrical arrangement of a combined spinning nozzle according to the invention.

An exemplary embodiment of a single-ended linear combined spinning nozzle according to the invention is shown in FIGS. 1 and 2. The first wall of the thin-walled electrode 1, which has the form of a thin plate in the present embodiment, is adjoined by the first wall of the first non-conductive body 2, the latter also having the plate-like form. Opposite the second wall of the thin-walled electrode 1, and in parallel with respect to the same, the second plate-like non-conductive body 4 is arranged, said wall being separated from said second body by the inner space 3. The thin-walled electrode 1 is connected to a high-voltage supply (not shown). The first non-conductive body 2 is provided with the grooves 5 which are substantially parallel to each other and extend from the proximal to the distal end 6 of the linear combined nozzle. The distal end 6 of the combined nozzle means that end of the linear combined nozzle around which the polymeric solution is spun after having been fed into the nozzle. In the present exemplary embodiment, the dimensions of the cross-sectional area of the grooves 5 are 1×2 mm. However, any other dimensions are conceivable, depending on the properties of the polymeric solution being spun. The inner space 3 serves for supplying the air and for directing the flowing air towards the distal end 6 of the linear combined nozzle. A collecting electrode (not shown) is arranged in a location having a given distance from the distal end 6 of the combined spinning nozzle and a high-voltage supply (also not shown) is coupled between the collecting electrode and the thin-walled electrode 1.

When the nozzle is working, the polymeric solution is pressed out through the grooves 5 towards the distal end 6 of the combined nozzle. Subsequently, after having reached the edge of the thin-walled conductive electrode 1, the polymeric solution is formed into small droplets or into a continuous thin layer having a small radius of curvature. Since the capillary forces are dependent on the surface tension and on the size of the element of surface of the respective liquid in direct proportion and on its radius of curvature in inverse proportion, a small droplet poses an ideal source for the production of microfibres or nanofibres in a spinning process. A significant gradient of the electrostatic field generated at the distal end of the thin-walled electrode 1 induces the extraction of the droplets, which will form a fibre, from the polymeric solution. Then, the droplets move towards a collecting electrode, the latter having zero voltage in the present embodiment. This movement of the droplets is also supported by the air stream which is forced towards the distal end 6 of the linear combined nozzle. The number of the microfibres or nanofibres being simultaneously formed is approximately equal to the number of the grooves 5. Thus, the number of fibres is only limited with respect to the practical feasibility. The use of the single-ended linear combined spinning nozzle according to the invention increases the efficiency in production of microfibres and nanofibres having stable composition and quality properties. This is due to the fact that a single-ended linear combined nozzle protects the polymeric solution being processed against harmful effects of the surroundings since the polymeric solution does not come into contact with the ambient air before a droplet is formed at the distal end of the linear combined nozzle, the development of droplets being immediately followed by the formation of a microfibre or nanofibre. Thus, the individual constituents of the polymeric solution are prevented from evaporating and no variations of the constitution of the microfibres or nanofibres being formed can occur. Another advantage is related to the easy maintenance and cleaning of the linear combined nozzle since the individual parts of the latter can be dismantled in a simple manner making the planar surfaces of the first non-conductive body 2 with the exposed grooves 5 as well as the surfaces of the thin-walled electrode 1 accessible for cleaning.

An exemplary embodiment of a double-ended linear combined spinning nozzle according to the invention is shown in FIGS. 3 and 4. The first wall of the thin-walled electrode 1, which has the form of a thin plate, is adjoined by the first wall of the first non-conductive body 2. Opposite the second wall of the first non-conductive body 2, and in parallel with respect to the same, the second non-conductive body 4 is arranged, said wall being separated from said second body by the inner space 3. The first wall of the first non-conductive body 2 is provided with the grooves 5, which are substantially parallel to each other and extend from the proximal to the distal end 6 of the linear combined nozzle. The second wall of the thin-walled electrode 1 is adjoined by the first wall of third non-conductive body 7. Opposite the second wall of the third non-conductive body 7, and in parallel with respect to the same, the fourth non-conductive body 8 is arranged, said wall being separated from said fourth body by the inner space 3. The first wall of the third non-conductive body 7 is provided with the grooves 5, which are substantially parallel to each other and extend from the proximal to the distal end 6 of the linear combined nozzle. The thin-walled electrode 1 is connected to a high-voltage supply (not shown). A collecting electrode (not shown) is arranged in a location having a given distance from the distal end 6 of the combined spinning nozzle and a high-voltage supply (also not shown) is coupled between the collecting electrode and the thin-walled electrode 1. In the present exemplary embodiment, the first, second, third and fourth non-conductive bodies 2, 4, 7 and 8 also assume plate-like shapes.

In operation, the function of the double-ended linear combined spinning nozzle according to the invention is similar to that of the single-ended linear combined spinning nozzle according to the invention. Again, the polymeric solution is pressed out by the grooves 5 towards the distal end 6 of the combined nozzle. Subsequently, after having reached the edge of the thin-walled conductive electrode 1, the polymeric solution is mixed and formed into small droplets or into a continuous thin layer having a small radius of curvature. A significant gradient of the electrostatic field generated at the distal end 6 of the thin-walled electrode 1 induces the extraction of the droplets, which will form a fibre, from the polymeric solution. Then, the droplets move towards a collecting electrode, the latter having zero voltage in the present exemplary embodiment. In the present embodiment, the number of the grooves 5 is increased twofold which may lead to an increased efficiency of the spinning process. This may also create new possibilities for improvement. In the exemplary embodiment of the invention, which is shown in FIGS. 3 and 4, the grooves 5 formed on the surface of the first non-conductive body 2 and on the surface of the third non-conductive body 7 are arranged directly opposite each other. In this case, the grooves 5 formed on the surface of the first non-conductive body 2 and those formed on the surface of the third non-conductive body 7 may be used for feeding different liquid mixtures. The preparation of reactive mixtures can immediately precede the initiation of the subsequent spinning process. This enables undesired reactions of the mixtures to be prevented during the spinning process. The inner space 3 serves for supplying the air and for directing the flowing air towards the distal end 6 of the linear combined nozzle.

Again, the number of the microfibres or nanofibres being simultaneously formed is approximately equal to the number of the grooves 5. Thus, the number of fibres is only limited with respect to the practical feasibility. The use of the double-ended linear combined spinning nozzle according to the invention, similarly to that of the single-ended linear combined spinning nozzle to the invention, increases the efficiency in production of microfibres and nanofibres having stable composition and quality properties. Both the single-ended and the double-ended linear combined spinning nozzles protect the polymeric solution being processed against harmful effects of the surroundings since the polymeric solution does not come into contact with the ambient air before a droplet is formed at the distal end of the linear combined nozzle, the development of droplets being immediately followed by the formation of a microfibre or nanofibre. Thus, the individual constituents of the polymeric solution are prevented from evaporating and no variations of the constitution of the microfibres or nanofibres being formed can occur. Another advantage is related to the easy maintenance and cleaning of the linear combined nozzle since the individual parts of the latter can be dismantled in a simple manner making the planar surfaces of the first and third non-conductive bodies 2, 7 with the exposed grooves 5 as well as the surfaces of the thin-walled electrode 1 accessible for cleaning.

An exemplary embodiment of a cylindrical combined spinning nozzle according to the invention is shown in FIG. 5. This spinning nozzle comprises the cylindrical thin-walled electrode 1 which gradually passes into a shank towards the proximal end and is accommodated inside the hollow cylinder 10 made of a non-conductive material. The cylindrical thin-walled electrode accommodates 1 the first conductive body 2 that is formed by a solid cylinder provided with an array of grooves on its outer surface, said grooves extending towards the distal end 6 of the cylindrical combined spinning nozzle. The proximal end portion of the first non-conductive body 2 is provided with the feeding channel 11 having the form of a ring encircling the first non-conductive body 2 and receiving both the proximal mouths of all the grooves 5 and the mouth of the feeding line for the polymeric solution. The collecting electrode 9 is arranged in a location having a given distance from the distal end 6 of the combined spinning nozzle and a high-voltage supply (not shown) is coupled between the collecting electrode and the thin-walled electrode 1. The cylindrical combined spinning nozzle is embedded into the retaining cup 12. The proximal end 13 of the thin-walled electrode 1 carries the nozzle holder 14 which is provided with the channel 15 for accommodating a high-voltage supply line of the thin-walled electrode 1.

With respect to all the above embodiments of the spinning nozzle according to the invention, it becomes apparent that the voltage, i.e. the electric potential difference between the thin-walled electrode 1 and the collecting electrode 9 is important for the function of the combined spinning nozzle according to the invention, rather than the individual electric potential of the thin-walled electrode 1 itself.

In operation, the function of the cylindrical combined spinning nozzle according to the invention is similar to that of the aforesaid linear combined spinning nozzle according to the invention. The polymeric solution is pressed out through the grooves 5 from the feeding channel 11 towards the distal end 6 of the combined nozzle. Subsequently, after having reached the edge of the thin-walled conductive electrode 1, the polymeric solution is mixed and formed into small droplets or into a continuous thin layer having a small radius of curvature. A significant gradient of the electrostatic field generated at the distal end 6 of the thin-walled electrode 1 induces the extraction of the droplets, which will form a fibre, from the polymeric solution. Then, the droplets move towards a collecting electrode, the latter being arranged opposite the distal end 6 of the cylindrical combined spinning nozzle and having zero voltage in the present exemplary embodiment. This movement of the droplets is also supported by the air stream which is forced through the inner space 3 towards the distal end 6 of the linear combined nozzle. The number of the microfibres or nanofibres being simultaneously formed is approximately equal to the number of the grooves 5. Thus, the number of fibres is only limited with respect to the practical feasibility. The use of the cylindrical linear combined spinning nozzle according to the invention increases the efficiency in production of microfibres and nanofibres having stable composition and quality properties. This is due to the fact that a cylindrical combined nozzle protects the polymeric solution being processed against harmful effects of the surroundings since the polymeric solution does not come into contact with the ambient air before a droplet is formed at the distal end of the linear combined nozzle, the development of droplets being immediately followed by the formation of a microfibre or nanofibre. Thus, the individual constituents of the polymeric solution are prevented from evaporating and no variations of the constitution of the microfibres or nanofibres can occur. Another advantage is related to the easy maintenance and cleaning of the cylindrical combined nozzle since the individual parts of the latter can be dismantled in a simple manner making the planar surfaces of the first non-conductive body 2 with their exposed grooves 5 as well as the surfaces of the thin-walled electrode 1 accessible for cleaning.

The combined spinning nozzle according all the above described embodiments of the invention enables the fibres to be formed from diverse types of synthetic and natural polymers which are not easily transformable into nanofibres or microfibres. Owing to the use of the thin-walled electrode 1, the combined spinning nozzle according to the present invention multiplies the gradient forces of electrostatic fields, thus enabling higher forces to act on the polymeric solution. This, in turn. makes the formation of fibres markedly easier. The additional tangential forces, which act on the surface of the polymeric solution, facilitate the formation of fibres, particularly those manufactured from difficultly spinnable polymers. The spinning nozzle according to the invention will increase the overall productivity. It will be usable in the industrial production of nanofibrous or microfibrous materials by means of the electrostatic spinning method. At the same time, it will minimize the risk of clogging in the areas of the channels for distributing polymeric solutions inside the combined nozzle and facilitate the subsequent cleaning even if multiple nozzles are used. Prior to the spinning process in itself, the polymeric mixture is not subject to higher temperatures. Moreover, the mixture is processed inside a closed space which prevents any changes in the physical and chemical properties of the polymeric solution to occur before the beginning of the spinning process.

This was achieved by means of the structural arrangement of the nozzle which is based on the results of the numerical simulation performed with the intention to demonstrate the distributions of air streamlines and electrostatic lines of force in the vicinity of the combined spinning nozzle according to the present invention. The above results have been verified by means of numerous spinning experiments involving both the synthetic polymers and the natural ones, the latter being difficultly spinnable. The design of the nozzle according to the invention overcomes the existing problems related to the nozzles, which are known in the art, namely inadequate distribution of electrostatic fields, frequent clogging and difficult cleaning of nozzles, low productivity, and varying properties of polymeric mixtures during the spinning process. The combined spinning nozzle according to the invention implements the optimum ways of proportioning and forming of polymeric mixtures, favourable distributions of electrostatic lines of force when being subject to a high voltage and favourable distributions of air streamlines. Thus, the influence of the air, which is fed into the nozzle, cam be minimized.

The polymeric mixture is proportioned through the thin grooves 5 formed between the metallic thin-walled electrode 1 and the adjacent first non-conductive body 2 or, as the case may be, the adjacent third non-conductive body 7. When being pressed out, the polymeric mixture is spontaneously formed into small droplets at the edge of the conductive thin-walled electrode 1. Such initial formation of the polymeric mixture creates the conditions which are favourable for the development of Taylor cones and for the subsequent initiation of the spinning process in itself. After having been prepared in the above manner, the polymeric mixture remains confined inside a closed space. Thus, any desirable changes in the physical and chemical parameters of the polymeric mixture due to the evaporation of its components can be effectively avoided. Another advantage of the combined spinning nozzle according to the invention consists in that all the components of the nozzle are very easy to clean because the latter does not contain any thin and long apertures (such as capillary tubes and the like) which would be inaccessible. The design of the combined spinning nozzle in itself is devised in such a way that the nozzle is very easy do dismantle and larger components of the same are easy to wash.

When the thin-walled electrode 1 is connected to a high electric potential, which generates a strong electrostatic field, the strongest gradient of that electrostatic field develops in a small area of the thin-walled electrode 1, i.e. in the area that corresponds to the spot at the distal end of the thin-walled electrode 1 where a droplet of the polymeric solution is being formed. Such significant gradient forces of the electrostatic field are essential for the formation of a Taylor cone and for the initiation of the subsequent spinning process. The design of combined spinning nozzle is favourably based on a thin capillary nozzle which has several distinct advantages including, among others, easy cleaning and negligible risk of clogging during the spinning process along with the incomparably higher productivity.

Another advantage of the arrangements described with reference to the present invention consist in a high efficiency of the combined spinning nozzles which cannot be achieved by any of the known types of spinning nozzles without being accompanied by the drawbacks of the prior art, such as clogging, changes in parameters of polymeric solutions during the spinning process, subsequent complicated cleaning, or the like. Such high efficiency level is achieved by the multiplication of the distributing channels on the flat surfaces of a single-ended or double-ended linear combined spinning nozzle or on the curved surface of a cylindrical combined spinning nozzle, and by the resulting development of numerous miniature droplets from which Taylor cones and, subsequently, the fibres in themselves are formed.

Moreover, all the above embodiments of the combined spinning nozzle utilize an additional flowing air component supporting through its tangential forces the development of Taylor cones and the subsequent formation of the fibres without affecting the properties of the polymeric solution to be spun due to increased temperature. The flow rate of the air can be controlled to increase the volume of the polymeric solution being spun, thus improving the productivity of the overall process. Besides that, possible temperature control favourably influences the climatic conditions both in the points, where the individual fibres are formed, and inside the whole deposition chamber. Thus, the physical quantities related to the properties of the air, such as flow rate and temperature, are regulated parameters which enable the process to be controlled with the aim to obtain the desired morphological properties of nanofibrous and microfibrous materials.

Example 1

In a preferred embodiment of the invention, the single-ended combined nozzle for performing the electrostatic spinning method comprises three parallel plate-like components, as shown in FIGS. 1 and 2. The first non conductive body 2 having a thickness of 5 mm is in a close contact with the thin-walled electrode 1 which is connected to the electric potential of a high-voltage supply. The wall of said electrode has 1 mm in thickness. On its surface adjoining the thin-walled electrode 1, the first non-conductive body 2 is provided with the grooves 5 having the dimensions of 1×2 mm a serving for the distribution of the polymeric mixture. The polymeric mixture is fed by the grooves 5 towards the edge of the thin-walled electrode 1 where it is mixed and formed into small droplets or into a continuous thin layer having a small radius of curvature. The second non-conductive body 4 is situated in the distance of 8 mm from the second wall of the thin-walled electrode 1, thus delimiting the inner space 3 which enables the flowing air to be supplied.

Example 2

In another preferred embodiment of the invention, the double-ended combined nozzle for performing the electrostatic spinning method comprises five parallel plate-like components which are arranged in the following order: second non-conductive body 4, first non-conductive body 2, thin-walled electrode 1, third non-conductive body 7, and fourth non-conductive body 8. Thus, the middle component is the thin-walled electrode 1 which is formed by a plate having 1 mm in thickness, 50 mm in height and 100 mm in length and which is connected to the electric potential of a high-voltage supply. On either side, the surfaces of the thin-walled electrode 1 are closely adjoined by the first non-conductive body 2, which is formed by a plate having 5 mm in thickness, and by the third non-conductive body 7, which also has 5 mm in thickness. On their surfaces adjoining the thin-walled electrode 1, the first and third non-conductive bodies 2, 7 are provided with the grooves 5 having the dimensions of 1×2 mm a serving for the distribution of two different liquid mixtures. Each mixture is individually fed by the corresponding grooves 5 towards the edge of the thin-walled electrode 1, which is centrally situated at the distal end 6 of the double-sided combined spinning nozzle, where the mixtures are blended and formed into small droplets or into a continuous thin layer having a small radius of curvature. The second non-conductive body 4 is situated in a longitudinal distance of 8 mm from the first non-conductive body 2, the inner space 3 formed between the two bodies serving for supplying and directing the air that flows towards the distal end 6 of the combined spinning nozzle. Likewise, the fourth non-conductive body 8 is situated in a longitudinal distance of 8 mm from the third non-conductive body 7, the inner space 3 formed between those two bodies serving for supplying and directing the air that flows towards the distal end 6 of the combined spinning nozzle.

Example 3

In still another preferred embodiment of the invention, the combined nozzle spinning nozzle comprises the thin-walled electrode 1 assuming the form of a thin-walled hollow cylinder, which has the diameter of 50 mm and the wall thickness of 1 mm. The inner side of the wall of said cylinder is adjoined by the first non-conductive body 2 having the fowl of a solid cylinder. The surface of said solid cylinder is provided with 16 grooves 5 having the dimensions of 1×2 mm and serving for feeding the polymeric mixture. The polymeric mixture is fed from a storage tank through the feeding channel 11 encircling the first nonconductive body 2 into the grooves 5 and subsequently pressed out through said grooves as well as through the orifices, which are arranged downstream the latter, towards the edge of the thin-walled electrode 1 where the mixture is subsequently formed into small droplets. The flow rate of the polymeric mixtures ranges between 10 and 10 000 μl/min. The second non-conductive body 4, also having the shape of a hollow cylinder, is affixed in a certain outward distance from the thin-walled electrode 1. In this exemplary embodiment, the distance of 8 mm between the thin-walled electrode 1 and the second non-conductive body 4 delimits the inner space 3 that serves for supplying the stream of preheated air, the temperature and flowrate of the air ranging from 20 to 100° C. and from 0 to 1000 l/min, respectively, The inner space 3 accommodates the hollow non-conductive cylinder 10 having electric and thermal insulating properties. Thus, the gradient of the electric field is better focused and amplified, the heat transfer from the flowing air through the thin-walled electrode 1 into the polymeric mixture is prevented from occurring and, moreover, the external circumference of the envelope of the electric field is suitably shaped to retain the superfluous polymeric mixture.

INDUSTRIAL APPLICABILITY

The invention is particularly useful for the laboratory preparation and industrial production of fibrous materials, such as materials composed of nanofibres or microfibres, by means of the electrostatic spinning method.

The invention claimed is:

1. A combined spinning nozzle for a production of nanofibrous or microfibrous materials, wherein the combined spinning nozzle comprises a thin-walled electrode and a first non-conductive body adjoining the first wall of said thin-walled electrode, said first non-conductive body having its wall, which faces said thin-walled electrode, provided with an array of grooves formed therein, said grooves leading to a distal end of said combined spinning nozzle and having their proximal ends connected to a supply of a spinning mixture.

2. The combined spinning nozzle for the production of nanofibrous or microfibrous materials according to claim 1, wherein the combined spinning nozzle further comprises a second non-conductive body adjoining a second wall of said thin-walled electrode and directing an air towards said distal end of said combined spinning nozzle.

3. The combined spinning nozzle for the production of nanofibrous or microfibrous materials according to claim 2, wherein said thin-walled electrode assumes a form of a cylindrical shell, in which said first non-conductive body having a cylindrical shape and being provided with grooves on its surface is accommodated, the outer surface of said first body adjoining the inner surface of said cylindrical shell, while said second non-conductive body, serving to direct the air towards said distal end of said combined spinning nozzle, is shaped as a cylindrical sheath, said thin-walled electrode being accommodated in a cylindrical casing made of a non-conductive material, the latter and said second non-conductive body defining a coaxial inner space therebetween for directing the air towards said distal end of said combined spinning nozzle.

4. The combined spinning nozzle for the production of nanofibrous or microfibrous materials according to claim 3, wherein a distal end of said cylindrical casing made of a non-conductive material is situated below the level of a distal end of said thin-walled electrode.

5. Combined spinning nozzle for the production of nanofibrous or microfibrous materials according to claim 2, wherein said thin-walled electrode, said first non-conductive body and said second non-conductive body have plate-like shapes, said first wall of said thin-walled electrode being adjoined by said first non-conductive body, the surface of the latter adjoining said thin-walled electrode being provided with grooves leading towards said distal end of said thin-walled electrode, and said second non-conductive body being arranged in parallel with respect to a second wall of said thin-walled electrode, thus creating a space between itself and said thin-walled electrode for directing an air towards said distal end of said combined spinning nozzle.

6. Combined spinning nozzle for the production of nanofibrous or microfibrous materials according to claim 2, wherein said nozzle is provided with third and fourth non-conductive bodies, said thin-walled electrode as well as said first, second, third and fourth non-conductive body having plate-like shapes, a second wall of said thin-walled electrode being adjoined by a first wall of said third non-conductive body, the surface of the latter adjoining said thin-walled electrode being provided with grooves extending from a proximal towards a distal end of said thin-walled electrode, said second non-conductive body being arranged opposite to a second wall of said first non-conductive body, thus defining a space between itself and said first non-conductive body, said space serving for directing an air towards said distal end of said combined spinning nozzle, and said fourth non-conductive body being arranged opposite to a second wall of said third non-conductive body, thus defining a space between itself and said third non-conductive body, said space also serving for directing the air towards said distal end of said combined spinning nozzle.

* * * * *